United States Patent [19]

Chopko

[11] Patent Number: 4,783,949

[45] Date of Patent: Nov. 15, 1988

[54] FLEXIBLE ADJUSTABLE WEDGE

[75] Inventor: Michael Chopko, Dallas, Pa.

[73] Assignee: Culbro Machine Systems, Kingston, Pa.

[21] Appl. No.: 164,539

[22] Filed: Mar. 7, 1988

[51] Int. Cl.[4] ..... B65B 43/26; B65B 65/00

[52] U.S. Cl. ..... 53/393; 53/291; 53/384; 53/567; 493/309

[58] Field of Search ..... 53/241, 256, 290, 291, 53/384, 393, 459, 554, 563, 567, 568; 269/48.1, 111–118; 493/302, 309, 436, 439, 490

[56] References Cited

U.S. PATENT DOCUMENTS

| | | | |
|---|---|---|---|
| 3,059,548 | 10/1962 | Kaplan et al. | 493/309 |
| 3,503,176 | 3/1970 | Crane et al. | 53/256 X |
| 3,961,459 | 6/1976 | Wolske | 53/384 X |
| 4.309,861 | 6/1982 | Karpisek | 53/567 X |
| 4,666,423 | 5/1987 | Herrington | 493/439 X |
| 4,693,059 | 9/1987 | O'Donnell | 493/309 X |

*Primary Examiner*—Robert L. Spruill
*Assistant Examiner*—Ann Tran
*Attorney, Agent, or Firm*—Morgan & Finnegan

[57] ABSTRACT

A flexible adjustable wedge of tetrahedronal structure is provided wherein four swivel-jointed arms are attached at their respective ends by pin connections. Flexible adjusting arms provide dimensional stability by interconnecting either opposing corners or opposing arms of the tetrahedronal wedge. The adjusting arms are provided with some degree of flexibility in order to allow the wedge to automatically conform its size to minor variations in the flat width of the film passing thereover. Where changes in overall size of the wedge are desired, the adjusting arms can be easily lengthened or shortened.

7 Claims, 3 Drawing Sheets

FLEXIBLE ADJUSTABLE WEDGE

BACKGROUND OF THE INVENTION

1. Field of the Invention

This invention relates to devices for applying a tubular member over a container and, more specifically, to flexible adjustable wedges for opening flattened heat shrinkable tubing.

2. Prior Art

In many industries, particularly the pharmaceutical industry, it is desirable to provide for the cap sealing of product containers for reasons of safety, tamper-proofing, sanitation, etc. Several known apparatus exist for effecting such desired cap sealing. One particularly advantageous apparatus is described in U.S. Pat. No. 4,562,684 to Hans Dreher, which disclosure is incorporated herein by reference.

Typically, such apparatus include a supply of flattened tubular heat shrinkable members, a pickup mechanism, means for opening the tubular members, means for delivering the opened tubular members to an application station, means for applying the opened tubular members to containers as they are conveyed past the application station and means for heating the tubular members so that they shrink around and conform to the shape of the containers thus sealing the containers.

The tubular material is generally supplied to the apparatus by loading pre-cut individual members into a hopper or by employing a continuous web of flattened tubular material that is cut into individual members. In apparatus in accordance with U.S. Pat. No. 4,562,684 the heat shrinkable film material is supplied as a flattened tube wound onto a supply roll. In processing this film material, an opening means is employed to relieve the material from its compressed, flattened state. This permits the preopened film material to be more readily machine-opened after being cut to length and makes it easier to apply it to the container for shrinking.

Prior art opening means for performing this preopening operation include a solid triangular wedge of fixed dimension, sized to operate on a given roll of film and solid triangular wedges having flexible members fixed in the corners of the wedge to allow for slight variations in the film dimensions. This capability is necessary because when tubular film manufacturers supply the rolls of material there is an inherent flat width variation. That variation can be exaggerated by some pre-shrinking of the film due to exposure to heat during the shipping and/or storage phase. Consequently, by the time the film is used on tamper evident machinery, the flat width of the film material can be several millimeters off specification and can result in manufacturing problems and excessive down time of the machine. For example, film material which, upon delivery, is off specification and, as a result, too small for the fixed dimension solid triangular wedge will not be able to fit over the wedge and will split the film and stop production.

The solid triangular wedge with corner mounted flexible members does allow for more variation in the flat film width. However, there are times when these variations are too large to be accommodated by the flexural capabilities of the flexible solid wedge. Further, there are many instances when the tamper evident machines must be adapted to another size product which requires film of a different flat width. Such a changeover using prior art wedge designs require the substitution of different wedges for each roll of film having a different flat width.

It is an object of the present invention to provide a flexible adjustable wedge for use with tamper evident machines for applying heat shrinkable tubular film wherein the wedge can accommodate wide variations in flat film width.

It is another object of this invention to provide a flexible adjustable wedge which is flexible to accommodate minor variations in film width without requiring removal of the wedge from the machine.

It is a further object of this invention to provide a flexible adjustable wedge that is simple in construction and can be easily adjustable without excessive down time of the machine.

SUMMARY OF THE INVENTION

In accordance with the above recited objectives, the flexible adjustable wedge of the present invention is a tetrahedronal structure formed by joining four jointed arms at their respective ends by pin connections. Dimensional stability is obtained by connecting two flexible adjusting means to opposite corners of the tetrahedronal structure. Each corner of the tetrahedron can be rounded to avoid snagging or tearing of the film material as it passes.

Alternatively, a single flexible adjusting means can be connected between the swivel joints of two opposing arms of the structure. This flexible adjusting means is shorter in overall length than the respective jointed arms such that, when the adjusting means is connected, the four jointed arms are held in a tetrahedronal position defined by four faces.

The adjusting means is provided with some degree of flexibility in order to allow the tetrahedronal structure to automatically conform its size to minor variations in the flat width of the film passing thereover.

Where changes in overall size of the wedge are desired, the adjusting means is manually lengthened or shortened to adapt the dimensions of the tetrahedronal structure to the specific flat width of the tubular film being used.

DETAILED DESCRIPTION OF PREFERRED EMBODIMENTS

Figure 1:
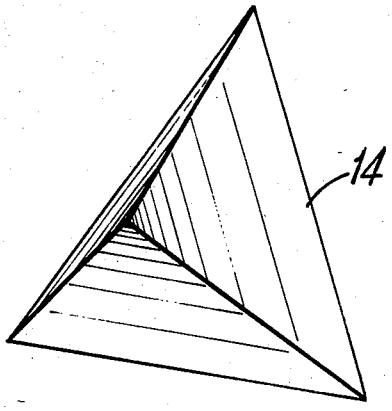
PRIOR ART FIG. 1
FIG. 1 is a perspective view of a solid non-flexible nonadjustable wedge in accordance with the prior art.
Figure 2:
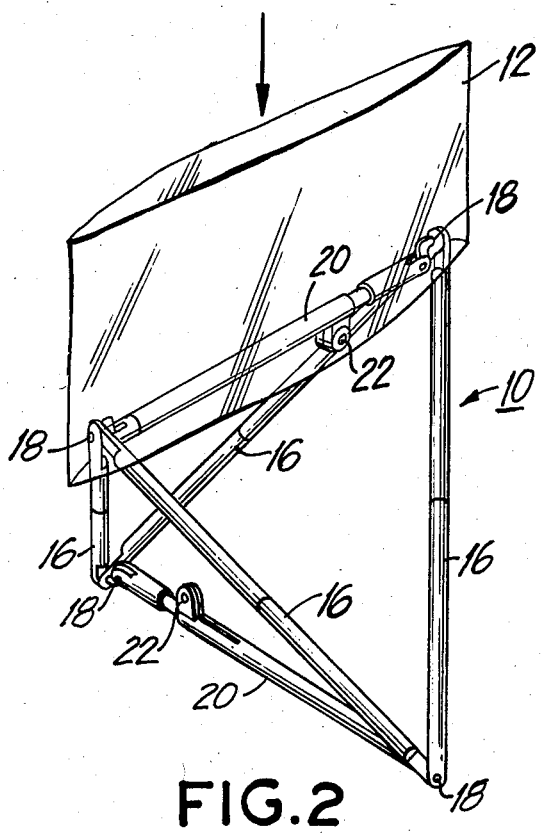
FIG. 2 is a perspective view of a flexible adjustable wedge having two flexible adjusting means in accordance with one embodiment of the present invention.
Figure 3:
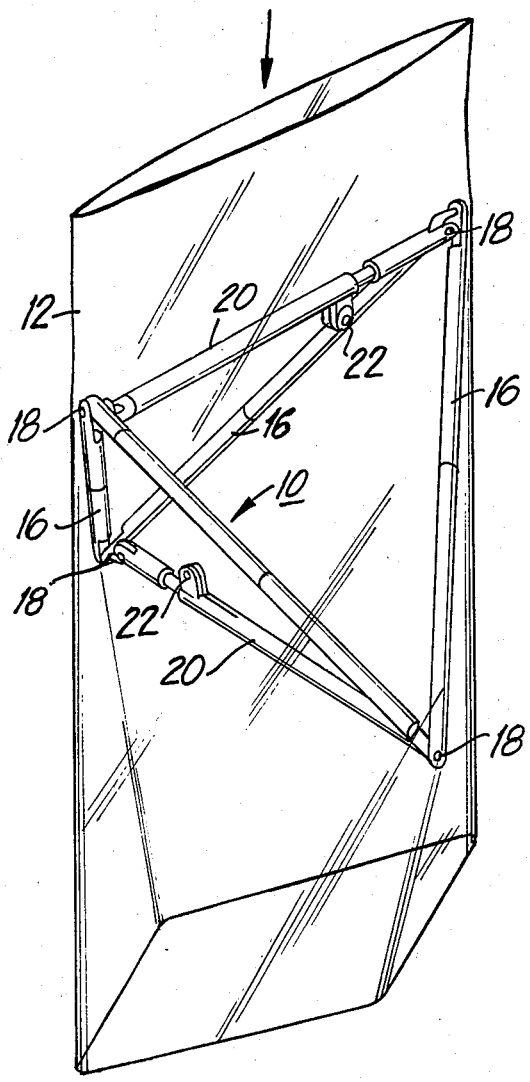
FIG. 3 is a perspective view of the flexible adjustable wedge of FIG. 2 in position within a section of tubular heat shrinkable film.
Figure 4:
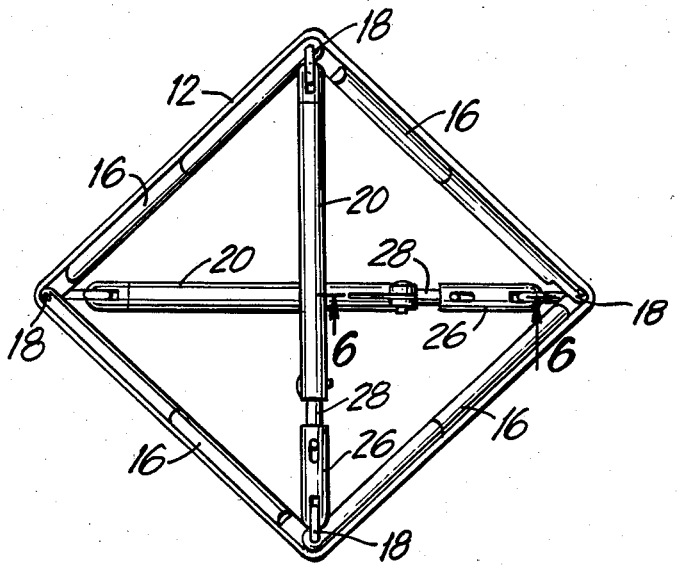
FIG. 4 is a bottom view of the flexible adjustable wedge of FIG. 2.
Figure 5:
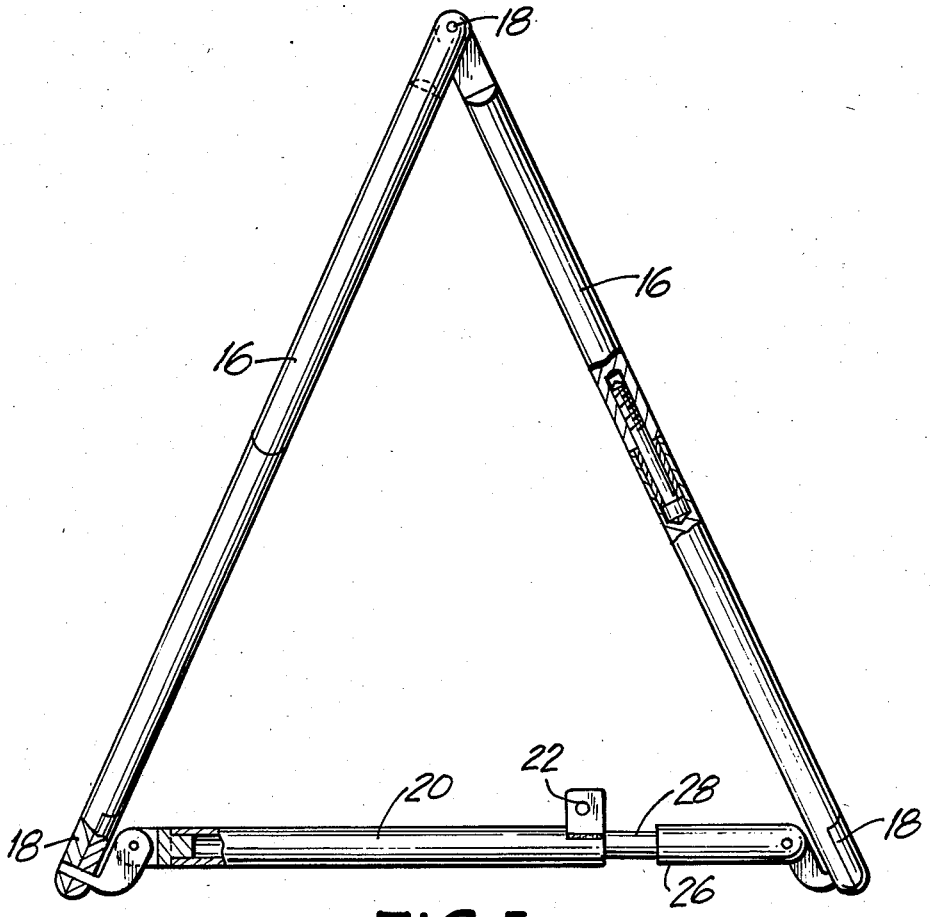
FIG. 5 is a side view in partial cross-section of the flexible adjustable wedge of FIG. 2.

Referring now to the drawings and, in particular, to FIG. 1, there is depicted a prior art wedge 14 comprising a solid tetrahedron dimensioned to fit tubular film of a given flat width. Whenever the flat width dimension of the film changed, either because of manufacturing deviations or shrinkage, the prior art wedge 14 was unusable and had to be replaced with a wedge of correct size.

The wedges in accordance with the present invention overcome this drawback by providing a dimensionally adjustable, flexible wedge shown generally at 10, designed for use in apparatus for applying tubular members over a container. Wedge 10 mounts in line to preopen flattened tubular heat shrinkable film 12 as it is drawn from a supply of said film. In the embodiment shown in FIGS. 2-5, wedge 10 is formed by connecting four swivel joint arms 16. These arms 16 connect to form four pivot corners 18. Adjusting arms 20 interconnect opposing pivot corners 18 to form a four-sided tetrahedronal wedge structure.

Adjusting arms 20 are generally formed from a two part telescoping tube which can be set at a given length by means of a clamp 22. The dimensions of the tetrahedronal wedge can therefore be controlled by setting the lengths of adjusting arms. In that manner, a single wedge can be adapted for use with a large number of sizes of tubular film.

Figure 6:
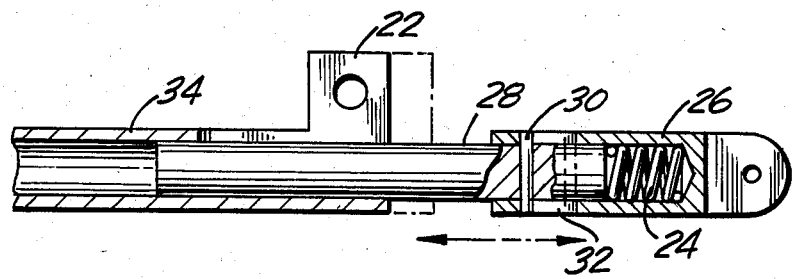
FIG. 6 is a partial side view in partial cross-section through line 6—6 of FIG. 4 of the flexible adjusting means of the flexible adjustable wedge of FIG. 2.

Minor variations in flat film length are compensated for by providing a compressible spring adjusting means into the adjusting arm 20. In the embodiment shown in FIG. 6, a compressible spring 24 is positioned inside receiving end 26 and compressed by rod 28. Rod 28 is held in receiving end 26 by means of a pin 30 which travels in slot 32. Rod 28 fits into the bore of sleeve 34, which bore is tightened by clamp 22. In this embodiment, a slight reduction in the film width will cause receiving end 26 to compress onto rod 20 thus reducing the width dimensions of the wedge. In this manner, minor fluctuations in film width can be compensated for inline by the wedge without the need to change or adjust wedges and without damage to or tearing of the tubular film.

Figure 7:
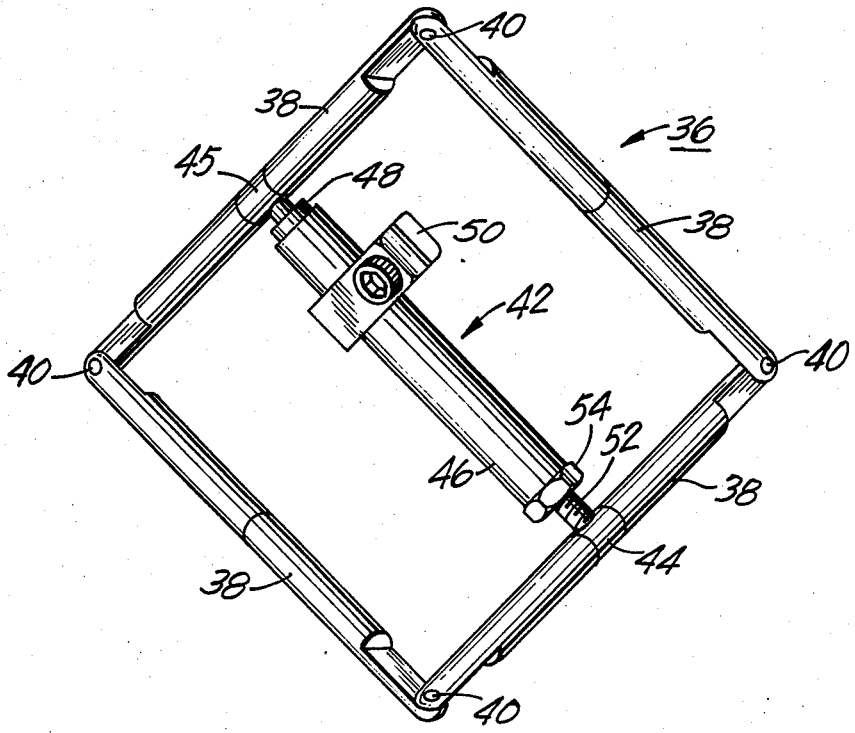
FIG. 7 is a perspective view of a flexible adjustable wedge having a single flexible adjusting means in accordance with another embodiment of the present invention.

A second embodiment, shown in FIG. 7, also forms a tetrahedronal wedge structure which is both adjustable and flexible. The wedge, shown generally at 36, is formed by connecting four swivel joint arms 38 at four pivot joint corners 40. The ends of the arms 38 are rounded so as to form a smooth surface in contact with the tubular film The ends of arms 38 are machined to form a lap joint at pivot joint 40 to facilitate flexing of the arms.

Arms 38 are held in proper tetrahedronal configuration by means of an adjustable flexible arm 42. This adjustable arm 42 connects two opposing arms 38 at swivel joints 44 and 45. Arm 42 is formed from an outer sleeve 46 which threadably attaches to swivel joint 44 by adjusting screw 52. Outer sleeve 46 receives an inner sleeve 48 telescopically therein, which inner sleeve 48 is attached to flexible joint 45. Inner sleeve 48 is adjustably positioned by means of clamp 50 which effectively locks the adjusting arm 42 at a given length. Minor adjustments can also be made by rotatably moving outer sleeve 46 on adjusting screw 52. When the desired length is achieved, locking nut 54 secures the outer sleeve in place.

Flexibility is imparted by a spring loaded rotatable joint (not shown) inside inner sleeve 48. The configuration of this spring-load rotatable joint is similar to that shown in FIG. 6.

The foregoing is considered as illustrative only of the principles of the present invention and is not limited to th particular embodiment discussed herein. Various changes, substitutions and modifications may be made thereto by those skilled in the art without departing from the spirit or scope of the invention defined by the appended claims.

What is claimed is:

1. A flexible adjustable wedge for expanding a tubular member in apparatus for applying said tubular member over an article, said wedge comprising:

four arms pivotally connected end-to-end by means of swivel joints;

at least one adjusting arm interconnecting two of said arms; and compressible spring adjusting means formed in said adjusting arm to permit said wedge to flex.

2. A flexible adjustable wedge as in claim 1 wherein said adjusting arm comprises an outer sleeve connected to one of said arms by an adjusting screw; and an inner sleeve telescopically attached to said outer sleeve by a clamp and connected to the other of said arms by a spring loaded rotatable joint.

3. A flexible adjustable wedge as in claim 1 wherein said adjusting arm is shorter than said arms.

4. A flexible adjustable wedge as in claim 2 wherein said adjusting arm further comprises a locking nut threadably engaging said adjusting screw to lock said outer sleeve in place

5. A flexible adjustable wedge for expanding a tubular member in apparatus for applying said tubular member or an article comprising: four swivel joint arms connected end to end at pivot four arms pivotally connected end-to-end by mans of swivel;

two adjusting arms interconnecting opposing swivel joints; and compressible spring adjusting means formed in said adjusting arms to permit said wedge to flex.

6. A flexible adjustable wedge as in claim 5 wherein said adjusting arms comprise outer hollow sleeves connected to receiving ends by spring loaded rods; and clamp means for locking said rods inside said outer hollow sleeves.

7. A flexible adjustable wedge as in claim 6 wherein said compressible spring adjusting means comprises receiving ends connected to said rods by means of pins extending into longitudinal slots in said receiving ends.

* * * * *